US009306317B2

(12) United States Patent
Kunieda

(10) Patent No.: US 9,306,317 B2
(45) Date of Patent: Apr. 5, 2016

(54) AIRTIGHT COAXIAL CONNECTOR

(71) Applicant: SMK Corporation, Tokyo (JP)

(72) Inventor: Hironori Kunieda, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 14/679,204

(22) Filed: Apr. 6, 2015

(65) Prior Publication Data

US 2015/0349454 A1 Dec. 3, 2015

(30) Foreign Application Priority Data

May 28, 2014 (JP) ..... 2014-109668

(51) Int. Cl.

| | |
|---|---|
| ***H01R 9/05*** | (2006.01) |
| ***H01R 13/52*** | (2006.01) |
| ***H01R 24/40*** | (2011.01) |
| *H01R 103/00* | (2006.01) |

(52) U.S. Cl.

CPC ..... *H01R 13/5205* (2013.01); *H01R 13/5216* (2013.01); *H01R 24/40* (2013.01); *H01R 2103/00* (2013.01)

(58) Field of Classification Search

CPC ..... H01R 13/5216; H01R 13/5219
See application file for complete search history.

(56) References Cited

U.S. PATENT DOCUMENTS

| | | | | |
|---|---|---|---|---|
| 4,299,434 | A * | 11/1981 | Ishikawa | H01R 24/40 439/391 |
| 5,662,480 | A * | 9/1997 | Togashi | H01R 24/50 439/582 |
| 7,553,185 | B1 * | 6/2009 | Qu | H01R 13/5219 439/578 |
| 8,851,925 | B2 * | 10/2014 | Kataoka | H01R 13/405 439/604 |
| 2009/0305560 | A1 * | 12/2009 | Chen | H01R 13/5219 439/584 |
| 2014/0134876 | A1 | 5/2014 | Vaccaro et al. | |

FOREIGN PATENT DOCUMENTS

| | | | |
|---|---|---|---|
| JP | 2001-257510 | A | 9/2001 |
| JP | 2012-059652 | A | 3/2012 |
| WO | WO-88/04437 | A1 | 6/1988 |
| WO | WO-2012/050238 | A1 | 4/2012 |

OTHER PUBLICATIONS

European Search Report mailed Oct. 23, 2015, issued for the European patent application No. 15001566.7.

* cited by examiner

*Primary Examiner* — Briggitte R Hammond
(74) *Attorney, Agent, or Firm* — Locke Lord LLP

(57) ABSTRACT

There is provided a coaxial connector that can ensure high airtightness without using a costly hermetic sealing component. An airtight coaxial connector includes: a resin filling space portion formed more to a coaxial cable connection side than to an insulator in an outer shell; a resin inlet that is open more to a target connector connection side than to the insulator in the outer shell and communicates with the resin filling space portion; and an airtightness resin that is filled in the resin filling space portion through the resin inlet and seals between a central conductor and the outer shell and between a dielectric of a coaxial cable and the outer shell.

12 Claims, 9 Drawing Sheets

AIRTIGHT COAXIAL CONNECTOR

CROSS REFERENCE TO RELATED APPLICATION

This application claims priority to Japanese Application No. 2014-109668 filed May 28, 2014 which is assigned to the assignee of the present application and is incorporated by reference herein.

BACKGROUND

1. Technical Field

The present invention mainly relates to an airtight coaxial connector which is used to connect a coaxial cable used to transmit high-frequency signals, to a precision instrument such as broadcasting equipment or an electron microscope.

2. Related Art

Precision instruments such as broadcasting equipment and electron microscopes may require airtightness. There is developed a coaxial connector that connects such precision instruments to a coaxial cable for transmitting high-frequency signals and that also has airtightness (see, for example, JP 2001-257510 A).

This airtight coaxial connector has, for example, a central terminal to which a central conductor of a coaxial cable is connected; and a metal shell disposed outside the central terminal. The airtight coaxial connector uses a hermetic component that seals a gap between the central terminal and the metal shell by an airtight sealing material such as glass. The hermetic component is incorporated into a metal outer shell, and the outer shell and the metal shell are soldered to each other with no gap therebetween and are thereby hermetically sealed.

SUMMARY

However, a conventional airtight coaxial connector such as that described above requires a special technique for manufacturing a hermetic sealing component, which causes problems that it is very costly and there are only a limited number of people who can manufacture the hermetic sealing component.

In addition, when a technique for manufacturing a hermetic sealing component is not available, a manufacturer of a coaxial connector purchases a general-purpose hermetic sealing component from other companies and incorporates the hermetic sealing component into a coaxial connector manufactured thereby, which causes problems of an increase in assembling manhours, resulting in poor work efficiency, and limited flexibility in design.

In view of such conventional problems, an object of the present invention is therefore to provide an airtight coaxial connector capable of ensuring high airtightness without using a costly hermetic sealing component.

To solve the conventional problems described above and achieve the intended purpose, the invention according to a first aspect provides an airtight coaxial connector that has a cylindrical outer shell to which an outer conductor of a coaxial cable is connected; a central contact concentrically disposed inside the outer shell and having a central conductor of the coaxial cable connected thereto; and an insulator interposed between the outer shell and the central contact, and that has the coaxial cable connected to one of two sides in an axial direction thereof and has a target connector connected to an other side, the insulator in the outer shell being placed between the two sides, the airtight coaxial connector including: a resin filling space portion formed more to a coaxial cable connection side than to the insulator in the outer shell; a resin inlet that is open more to a target connector connection side than to the insulator in the outer shell and communicates with the resin filling space portion; and an airtightness resin that is filled in the resin filling space portion through the resin inlet and seals between the central conductor and the outer shell and between a dielectric of the coaxial cable and the outer shell.

In the invention according to a second aspect, in addition to the configuration of the first aspect, the airtight coaxial connector further includes an air release opening that is open on a target connector connection side in the outer shell and communicates with the resin filling space portion.

In the invention according to a third aspect, in addition to the configuration of the first or second aspect, the resin inlet and/or the air release opening are/is formed in a shape of a hole or a groove passing through the insulator in the axial direction.

In the invention according to a fourth aspect, in addition to the configurations of the first to third aspects, the central contact and the central conductor are connected to each other by soldering.

In the invention according to a fifth aspect, in addition to the configuration of the fourth aspect, the central contact has: a conductor insertion hole into which the central conductor is inserted; and a block hole that is open in an outer surface of the central contact and disposed so as to communicate with the conductor insertion hole, and the central conductor inserted into the conductor insertion hole is soldered to the central contact, and the block hole is sealed by solder.

As described above, an airtight coaxial connector according to the present invention has a cylindrical outer shell to which an outer conductor of a coaxial cable is connected; a central contact concentrically disposed inside the outer shell and having a central conductor of the coaxial cable connected thereto; and an insulator interposed between the outer shell and the central contact, and has the coaxial cable connected to one of two sides in an axial direction thereof and has a target connector connected to an other side, the insulator in the outer shell being placed between the two sides. The airtight coaxial connector includes: a resin filling space portion formed more to a coaxial cable connection side than to the insulator in the outer shell; a resin inlet that is open more to a target connector connection side than to the insulator in the outer shell and communicates with the resin filling space portion; and an airtightness resin that is filled in the resin filling space portion through the resin inlet and seals between the central conductor and the outer shell and between a dielectric of the coaxial cable and the outer shell. By this, high airtightness can be easily ensured without using a costly general-purpose hermetic sealing component. Moreover, the degree of flexibility in connector design is high.

In addition, in the present invention, an air release opening is provided that is open on the target connector connection side in the outer shell and communicates with the resin filling space portion. By this, air in the resin filling space portion is pushed out, by which the inside of the resin filling space portion can be filled with the airtightness resin, enabling to ensure high airtightness.

Furthermore, in the present invention, the resin inlet and/or the air release opening are/is formed in the shape of a hole or a groove passing through the insulator in the axial direction. By this, the resin inlet and the air release opening can be easily formed.

In addition, in the present invention, the central contact and the central conductor are connected to each other by soldering. By this, even if the central conductor is a stranded wire having a plurality of wire materials stranded to each other, the solder penetrates between the wire materials, enabling to achieve high airtightness.

Furthermore, in the present invention, the central contact has a conductor insertion hole into which the central conductor is inserted; and a block hole that is open in an outer surface of the central contact and disposed so as to communicate with the conductor insertion hole. The central conductor inserted into the conductor insertion hole is soldered to the central contact, and the block hole is sealed by solder. By this, high airtightness can be ensured by the solder.

DETAILED DESCRIPTION

Figure 1:
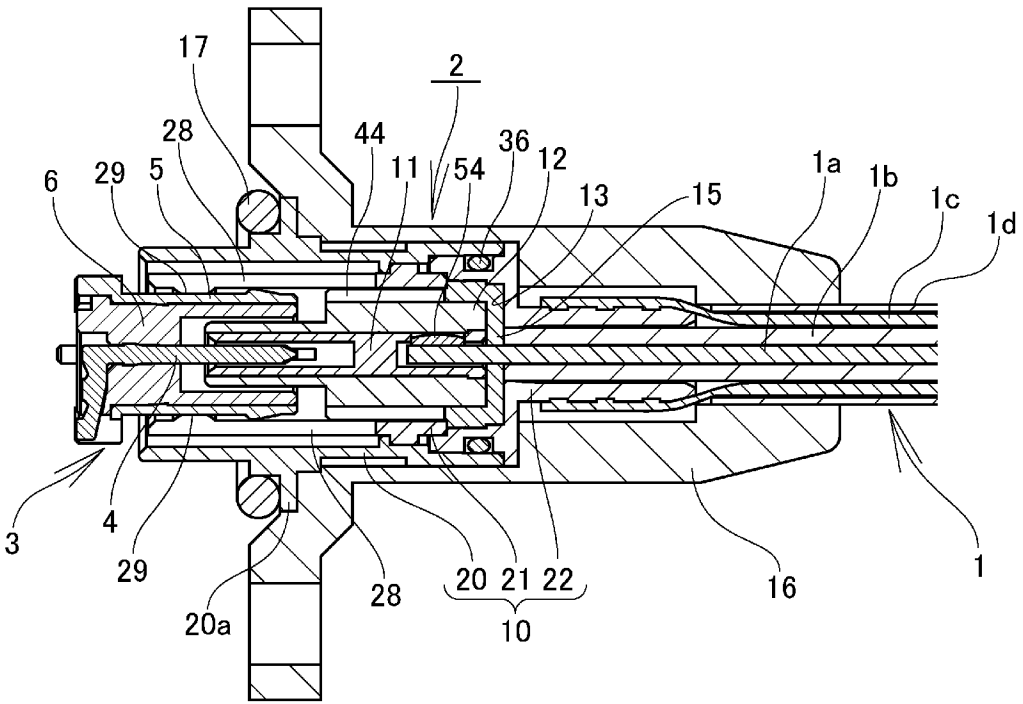
FIG. 1 is a lateral cross-sectional view showing a state in which an airtight coaxial connector according to the present invention and a target connector are connected to each other.
Figure 2:
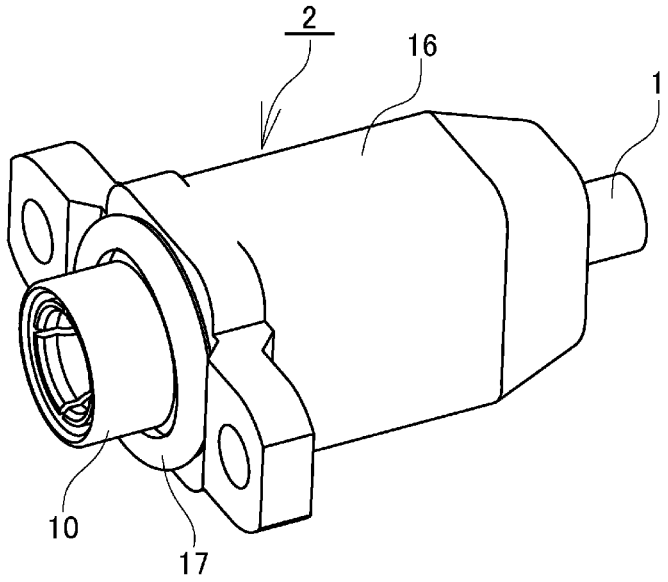
FIG. 2 is a perspective view of the airtight coaxial connector of FIG. 1.
Figure 3:
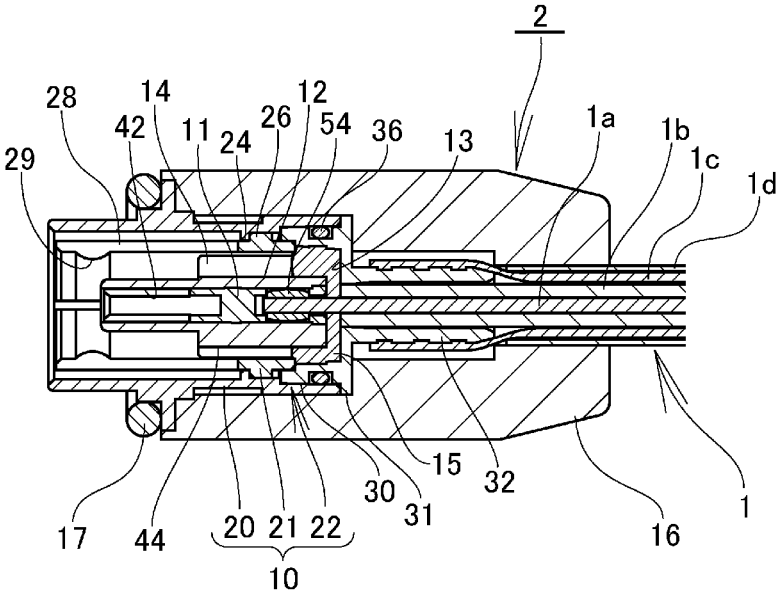
FIG. 3 is a longitudinal cross-sectional view of the airtight coaxial connector.
Figure 4:
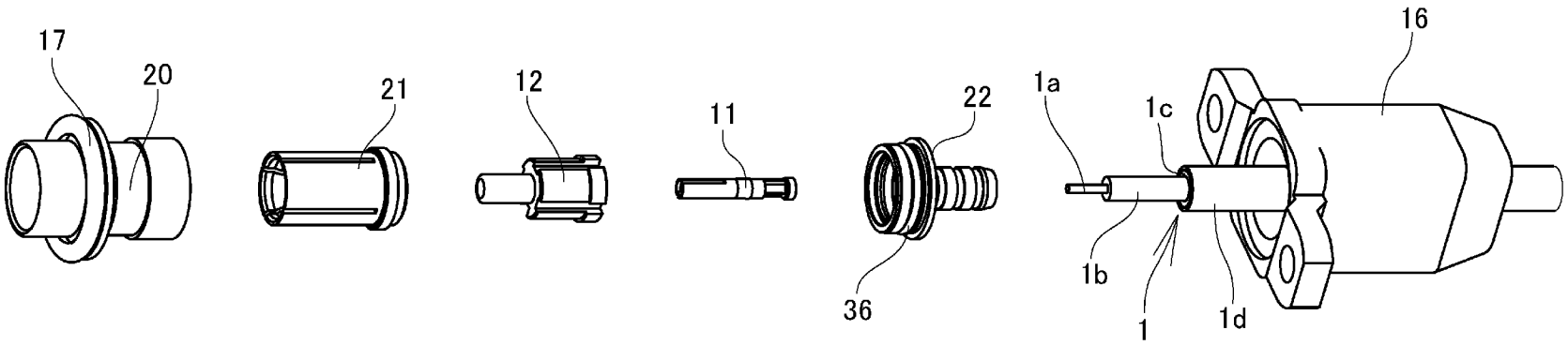
FIG. 4 is an exploded perspective view of the airtight coaxial connector.

Next, an embodiment of an airtight coaxial connector according to the present invention will be described based on an implementation example shown in FIGS. 1 to 9A and 9B. Note that in the drawings reference numeral 1 indicates a coaxial cable, reference numeral 2 indicates an airtight coaxial connector to which the coaxial cable 1 is connected, and reference numeral 3 indicates a target connector connected to the airtight coaxial connector 2.

As shown in FIG. 1, the target connector 3 has a pin-like target-side central contact 4, a cylindrical target-side outer shell 5 which is concentrically disposed outside the target-side central contact 4, and a target-side insulator 6 made of an insulating resin and interposed between the target-side central contact 4 and the target-side outer shell 5.

The airtight coaxial connector 2 has a cylindrical outer shell 10 to which an outer conductor 1*c* of the coaxial cable 1 is connected, a central contact 11 which is concentrically disposed inside the outer shell 10, and an insulator 12 interposed between the outer shell 10 and the central contact 11. The airtight coaxial connector 2 has the coaxial cable 1 connected to one of two side thereof, between which the insulator 12 in the outer shell 10 is provided, and has the target connector 3 connected to the other side.

In addition, the airtight coaxial connector 2 has a resin filling space portion 13 formed more to the coaxial cable connection side than to the insulator 12 in the outer shell 10; a resin inlet 14 which is open more to the target connector connection side than to the insulator 12 in the outer shell 10 and communicates with the resin filling space portion 13; and an airtightness resin 15 which is filled in the resin filling space portion 13 through the resin inlet 14 and seals between a central conductor 1*a* of the coaxial cable 1 and the outer shell 10 and between a dielectric 1*b* of the coaxial cable 1 and the outer shell 10. By this, airtightness is maintained between the coaxial cable connection side and the target connector connection side in the outer shell 10.

Note that in the present implementation example an outer housing 16 made of an insulating resin is provided outside the outer shell 10 and holds therein the outer shell 10 and an end portion of the coaxial cable 1, and a gap between the outer housing 16 and the outer shell 10 is sealed by a sealing member 17 such as an O-ring.

The outer shell 10 has a cylindrical outer shield member 20, a concentric cylindrical outer contact member 21 disposed inside the outer shield member 20, and a cable holding member 22 which fits into the coaxial cable connection side of the outer shield member 20. The outer shield member 20, the outer contact member 21, and the cable holding member 22 are assembled together so as to have continuity therebetween. The outer shell 10 forms a bottomed cylindrical shape with one side closed and the other side open.

Figure 5A:
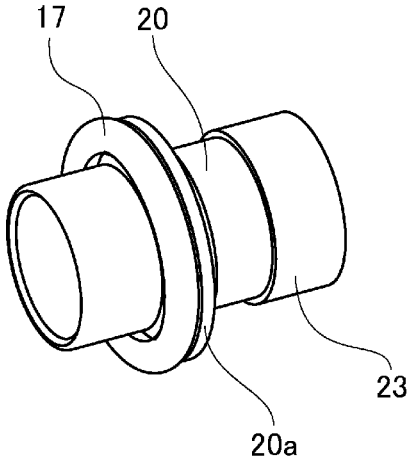
FIG. 5A is a perspective view showing an outer shield member of the airtight coaxial connector and FIG. 5B is a longitudinal cross-sectional view of the outer shield member.
Figure 5B:
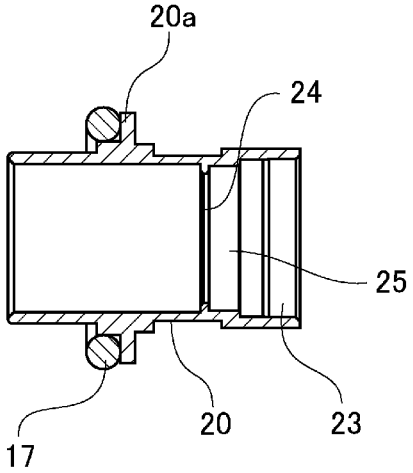
Figure 6A:
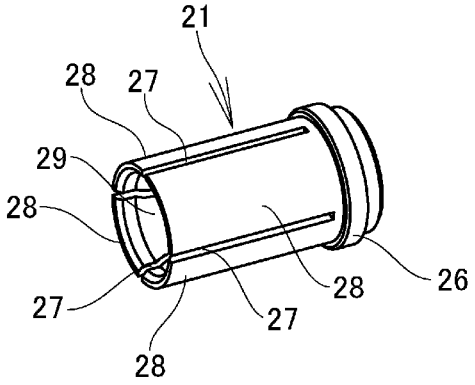
FIG. 6A is a perspective view showing an outer contact member of the airtight coaxial connector and FIG. 6B is a longitudinal cross-sectional view of the outer contact member.
Figure 6B:
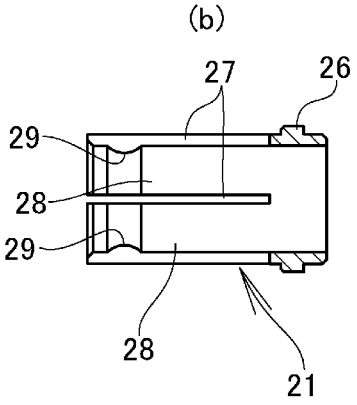

As shown in FIGS. 5A and 5B, the outer shield member 20 is formed of a conductive metal material and in a cylindrical shape. The outer shield member 20 has an expanded diameter portion 23 with an expanded inside diameter on its coaxial cable connection side. The cable holding member 22 fits into the expanded diameter portion 23.

The outer shield member 20 has, at an end portion on the coaxial cable connection side thereof, an annular stopper portion 24 which hangs over from an inner surface thereof. A contact fitting portion 25 into which an expanded-diameter fitting portion 26 of the outer contact member 21 which will be described later fits is formed on the coaxial cable connection side of the stopper portion 24.

In addition, a flange 20*a* which hangs over outwardly is protrudingly and integrally formed with an outer surface of the outer shield member 20. A sealing member 17 is held on the target connector connection side of the flange 20*a*.

The outer contact member 21 is integrally formed of an elastic, conductive metal material and is formed in a cylindrical form with both ends in an axial direction open.

The outer contact member 21 is formed such that the outside diameter thereof is smaller than the inside diameter of the outer shield member 20. The expanded-diameter fitting portion 26 whose outside diameter is substantially the same as the inside diameter of the outer shield member 20 is protrudingly and integrally formed around an end portion on the coaxial cable connection side of the outer contact member 21.

In addition, the outer contact member 21 has a plurality of slits 27, 27 . . . which are provided at intervals in a circumferential direction and whose ends on the target connector connection side are open. By the slits 27, 27 . . . , the cylindrical target connector connection side is divided, forming a plurality of cantilever spring-like elastic contact piece portions 28, 28 . . . .

A contact point portion 29 bulging inwardly is integrally formed with each of the elastic contact piece portions 28, 28 . . . . When the target connector 3 is connected, the contact point portion 29 comes into contact with an outer surface of the target-side outer shell 5 of the target connector 3.

By pressing the cable holding member 22 against the end portion on the coaxial cable connection side of the outer contact member 21 with the outer contact member 21 inserted into the outer shield member 20 from the coaxial cable connection side and the expanded-diameter fitting portion 26 fitting into the contact fitting portion 25 and stopped by the stopper portion 24, the expanded-diameter fitting portion 26 is fixed and the elastic contact piece portions 28, 28 . . . are held in a deformable state in a radius direction.

Figure 7A:
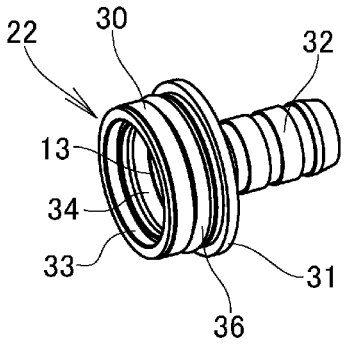
FIG. 7A is a perspective view showing a cable holding member of the airtight coaxial connector and FIG. 7B is a longitudinal cross-sectional view of the cable holding member.
Figure 7B:
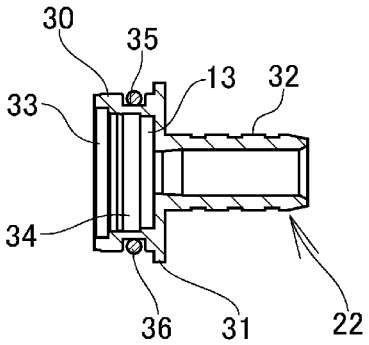

As shown in FIGS. 7A and 7B, the cable holding member 22 is integrally formed of a conductive metal material, and has a cylindrical airtight fitting portion 30; a disc-like cover portion 31 that closes an end surface on the coaxial cable connection side of the airtight fitting portion 30; and a cylindrical cable connecting portion 32 projecting toward the coaxial cable connection side from the center of the cover portion 31.

The airtight fitting portion 30 forms a multistep shape where the inside diameter of its inner hole portion gradually decreases from the target connector connection side. The airtight fitting portion 30 has a holding stepped portion 33 into which an end on the coaxial cable connection side of the outer contact member 21 fits; a flange holding stepped portion 34 into which a flange portion 43 of the insulator 12 which will be described later fits; and the recessed resin filling space portion 13, which are continuously formed.

In addition, a recessed groove 35 in a circumferential direction is formed around the airtight fitting portion 30. A sealing member 36 such as an O-ring fits into the recessed groove 35. By the sealing member 36, a gap between the airtight fitting portion 30 and the outer shield member 20 is sealed.

The cover portion 31 is formed such that the diameter thereof has substantially the same size as the outside diameter of the outer shield member 20. By fitting the airtight fitting portion 30 into the expanded diameter portion 23, the cover portion 31 abuts against an end surface of the outer shield member 20, closing an opening on the coaxial cable connection side of the outer shield member 20.

The cable connecting portion 32 is formed in a cylindrical shape where the cable connecting portion 32 passes through the cover portion 31 and communicates with the resin filling space portion 13. The end portion of the coaxial cable 1 whose outer sheath 1*d* and outer conductor 1*c* are removed is inserted into the cable connecting portion 32, and an end surface of the dielectric 1*b* is exposed within the resin filling space portion 13.

In addition, the outer conductor 1*c* of the coaxial cable 1 is connected and fixed on the outer side of the cable connecting portion 32 by crimping, etc.

Figure 8A:
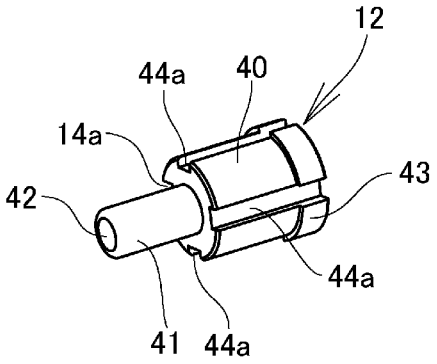
FIG. 8A is a perspective view showing an insulator of the airtight coaxial connector.
Figure 8B:
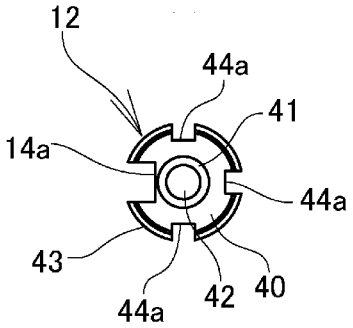
FIG. 8B is a front view of the insulator.
Figure 8C:
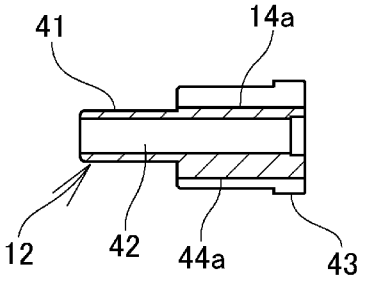
FIG. 8C is a longitudinal cross-sectional view of the insulator.
Figure 9A:
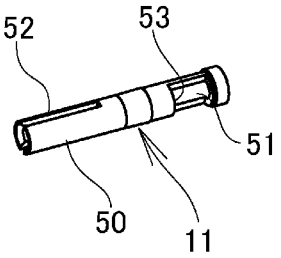
FIG. 9A is a perspective view showing a central contact of the airtight coaxial connector and FIG. 9B is a longitudinal cross-sectional view of the central contact.
Figure 9B:
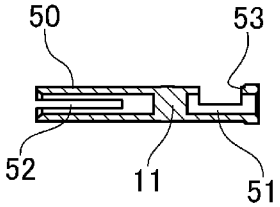

As shown in FIGS. 8A to 8C, the insulator 12 is formed in a circular cylindrical shape with a plurality of steps where a circular cylindrical insulator main body portion 40 and a circular cylindrical contact accommodation projection portion 41 projecting from the center of one end surface of the insulator main body portion 40 are concentrically continued.

In addition, a contact accommodation hole 42 passing through the center in an axial direction of the contact accommodation projection portion 41 and the insulator main body portion 40 is made in the insulator 12. The central contact 11 is inserted and accommodated into the contact accommodation hole 42, by which the outer shell 10 and the central contact 11 are concentrically disposed and the insulator 12 is interposed between the outer shell 10 and the central contact 11.

The insulator main body portion 40 is formed in a circular cylindrical shape where the flange portion 43 is integrally formed around an end portion on the coaxial cable connection side of the insulator main body portion 40. The insulator main body portion 40 fits into the inside of the outer shell 10, i.e., the inside of the outer contact member 21, and the flange portion 43 fits into the flange holding stepped portion 34 and is sandwiched between an end surface of the outer contact member 21 and the flange holding stepped portion 34, and the insulator 12 is fixed within the outer shell 10 and the resin filling space portion 13 is disposed on the coaxial cable connection side of the insulator 12.

In addition, an outer region of the insulator main body portion 40 has a recessed grooved resin inlet groove 14*a* passing through the insulator 12 in the axial direction; and a plurality of air release opening grooves 44*a*, 44*a* . . . disposed at intervals in a circumferential direction and passing through the insulator 12 in the axial direction. By the insulator main body portion 40 fitting into the outer contact member 21, the resin inlet groove 14*a* forms the resin inlet 14, and the air release opening grooves 44*a*, 44*a* . . . form air release openings 44 and 44 which are open more to the target connector connection side than to the insulator 12 in the outer shell 10 and which communicate with the resin filling space portion 13.

For the size of the resin inlet 14, a size (cross-sectional area) suitable for resin injection, i.e., a size suitable for use of a resin injection apparatus such as a dispenser, is secured. More specifically, a cross-sectional area is secured that allows a needle-like inlet of a dispenser to be inserted into the resin filling space portion 13 through the resin inlet 14.

The air release openings 44 and 44 are configured such that, when the airtightness resin 15 is filled in the resin filling space portion 13 through the resin inlet 14, air in the resin filling space portion 13 is pushed by the airtightness resin 15 and is thereby discharged from the air release openings 44 and 44.

The resin filling space portion 13 is a closed space that is enclosed by the airtight fitting portion 30 and that is sandwiched between the cover portion 31 and the end surface on the coaxial cable connection side of the insulator main body portion 40. The cable connecting portion 32, the resin inlet 14, and the air release openings 44 and 44 are in a state of communicating with the outside.

Then, the airtightness resin 15 is filled and cured into the resin filling space portion 13 through the resin inlet 14. By the airtightness resin 15, a gap between the central conductor 1*a* exposed within the resin filling space portion 13 through the cable connecting portion 32 and the outer shell 10 and a gap between the dielectric 1*b* of the coaxial cable 1 and the outer shell 10 are sealed.

In addition, by the airtightness resin 15, the opening portions on the space side of the resin inlet 14 and the air release openings 44 and 44 are also sealed.

For the airtightness resin 15, a resin is used that has high flowability and excellent filling properties before curing and exerts high airtightness after curing. For example, an epoxy-based resin is used.

The central contact 11 is formed of a conductive metal material and in a rod shape. The central contact 11 has, on the one-end side in an axial direction thereof, an elastic connecting portion 50 into which the target-side central contact 4 of the target connector 3 fits. The central contact 11 has, on the other-end side in the axial direction thereof, a conductor insertion hole 51 into which the central conductor 1*a* of the coaxial cable 1 fits.

The elastic connecting portion 50 has a pair of slits 52 and 52 whose ends on the target connector connection side are open. The pin-like target-side central contact 4 of the target connector 3 fits into the elastic connecting portion 50, by which the two central contacts 4 and 11 are connected to each other with a desired contact pressure.

The central contact 11 has a block hole 53 which is open in an outer surface of the central contact 11 and disposed so as to communicate with the conductor insertion hole 51. The central conductor 1*a* inserted into the conductor insertion hole 51 is soldered to the central contact 11, and the block hole 53 is sealed by solder 54.

Thus, since the block hole 53 is sealed by the solder 54, high airtightness between the central conductor 1*a* and the insulator 12 is ensured. Furthermore, even if the central conductor 1*a* of the coaxial cable 1 is a stranded wire made up of a plurality of cores, since the solder 54 penetrates between the cores, airtightness between the coaxial cable 1 and the central contact 11 can be increased.

The airtight coaxial connector 2 thus configured has the resin filling space portion 13 formed more to the coaxial cable connection side than to the insulator 12 in the outer shell 10. The airtightness resin 15 is filled into the resin filling space portion 13 through the resin inlet 14, sealing between the central conductor 1*a* and the outer shell 10 and between the dielectric 1*b* of the coaxial cable 1 and the outer shell 10 by the airtightness resin 15. By this, the more to the coaxial cable connection side than the insulator 12 in the outer shell 10 and the target connector connection side are hermetically sealed.

Note that the modes of the resin inlet 14 and the air release openings 44 and 44 are not limited to those of the above-described implementation example, and the resin inlet 14 and the air release openings 44 and 44 may be formed in the shape of circular holes passing through the insulator main body portion 40 of the insulator 12 in the axial direction, or grooves that communicate with the resin filling space portion 13 in the axial direction may be formed in an inner surface of the outer shell 10 in the axial direction and may be used as the resin inlet 14 and the air release openings 44 and 44.

REFERENCE SIGNS LIST

1 coaxial cable
2 airtight coaxial connector
3 target connector
4 target-side central contact
5 target-side outer shell
6 target-side insulator
10 outer shell
11 central contact
12 insulator
13 resin filling space portion
14 resin inlet
15 airtightness resin
16 outer housing
17 sealing member
20 outer shield member
21 outer contact member
22 cable holding member
23 expanded diameter portion
24 stopper portion
25 contact fitting portion
26 expanded-diameter fitting portion
27 slit
28 elastic contact piece portion
29 contact point portion
30 airtight fitting portion
31 cover portion
32 cable connecting portion
33 holding stepped portion
34 flange holding stepped portion
35 recessed groove
36 sealing member
40 insulator main body portion
41 contact accommodation projection portion
42 contact accommodation hole
43 flange portion
44 air release opening
50 elastic connecting portion
51 conductor insertion hole
52 slit
53 block hole
54 solder

What is claimed is:

1. An airtight coaxial connector that has a cylindrical outer shell to which an outer conductor of a coaxial cable is connected; a central contact concentrically disposed inside the outer shell and having a central conductor of the coaxial cable connected thereto; and an insulator interposed between the outer shell and the central contact, and that has the coaxial cable connected to one of two sides in an axial direction thereof and has a target connector connected to an other side, the insulator in the outer shell being placed between the two sides, the airtight coaxial connector comprising:

a resin filling space portion formed more to a coaxial cable connection side than to the insulator in the outer shell;

a resin inlet that is open more to a target connector connection side than to the insulator in the outer shell and communicates with the resin filling space portion; and an airtightness resin that is filled in the resin filling space portion through the resin inlet and seals between the central conductor and the outer shell and between a dielectric of the coaxial cable and the outer shell.

2. The airtight coaxial connector according to claim 1, further comprising an air release opening that is open on a target connector connection side in the outer shell and communicates with the resin filling space portion.

3. The airtight coaxial connector according to claim 1, wherein the resin inlet and/or the air release opening are/is formed in a shape of a hole or a groove passing through the insulator in the axial direction.

4. The airtight coaxial connector according to claim 1, wherein the central contact and the central conductor are connected to each other by soldering.

5. The airtight coaxial connector according to claim 4, wherein the central contact has:

a conductor insertion hole into which the central conductor is inserted; and a block hole that is open in an outer surface of the central contact and disposed so as to communicate with the conductor insertion hole, and the central conductor inserted into the conductor insertion hole is soldered to the central contact, and the block hole is sealed by solder.

6. The airtight coaxial connector according to claim 2, wherein the resin inlet and/or the air release opening are/is formed in a shape of a hole or a groove passing through the insulator in the axial direction.

7. The airtight coaxial connector according to claim 2, wherein the central contact and the central conductor are connected to each other by soldering.

8. The airtight coaxial connector according to claim 3, wherein the central contact and the central conductor are connected to each other by soldering.

9. The airtight coaxial connector according to claim 6, wherein the central contact and the central conductor are connected to each other by soldering.

10. The airtight coaxial connector according to claim 7, wherein the central contact has:

a conductor insertion hole into which the central conductor is inserted; and a block hole that is open in an outer surface of the central contact and disposed so as to communicate with the conductor insertion hole, and the central conductor inserted into the conductor insertion hole is soldered to the central contact, and the block hole is sealed by solder.

11. The airtight coaxial connector according to claim 8, wherein the central contact has:

a conductor insertion hole into which the central conductor is inserted; and a block hole that is open in an outer surface of the central contact and disposed so as to communicate with the conductor insertion hole, and the central conductor inserted into the conductor insertion hole is soldered to the central contact, and the block hole is sealed by solder.

12. The airtight coaxial connector according to claim 9, wherein the central contact has:

a conductor insertion hole into which the central conductor is inserted; and a block hole that is open in an outer surface of the central contact and disposed so as to communicate with the conductor insertion hole, and the central conductor inserted into the conductor insertion hole is soldered to the central contact, and the block hole is sealed by solder.

* * * * *